United States Patent [19]

Fukuda et al.

[11] Patent Number: 4,747,793

[45] Date of Patent: May 31, 1988

[54] BATTERY TERMINAL CONNECTOR

[75] Inventors: Kiyohito Fukuda; Takao Murakami, both of Shizuoka, Japan

[73] Assignee: Yazaki Corporation, Japan

[21] Appl. No.: 931,050

[22] Filed: Nov. 17, 1986

[30] Foreign Application Priority Data

Nov. 15, 1985 [JP] Japan ..... 60-174889[U]

[51] Int. Cl.[4] ..... H01R 4/38

[52] U.S. Cl. ..... 439/766; 439/754

[58] Field of Search ..... 339/224, 231, 232, 263 B

[56] References Cited

U.S. PATENT DOCUMENTS 3,407,383 10/1968 Haegert ..... 339/263 B

*Primary Examiner*—Gil Weidenfeld

*Assistant Examiner*—Paula A. Austin

*Attorney, Agent, or Firm*—Wigman & Cohen

[57] ABSTRACT

A battery terminal connector provided between a battery cable and a battery post erected from the battery body, which is made of a single metal plate, is provided with two holes through which the battery post is secured when the metal plates is folded to form a metal body, and has a stud bolt for connecting the battery cable. The erected stud bolt is firmly held by two wing portions formed in the lower plate of the metal body, which wing portions are bent at a right angle to embrace the square head of the stud bolt. A flat portion between the wing portions supports the bottom face of the inverted stud bolt.

4 Claims, 4 Drawing Sheets

BATTERY TERMINAL CONNECTOR

BACKGROUND OF THE INVENTION

1. Field of the Invention

This invention relates to a battery terminal connector for connecting a terminal of a battery cable to a battery terminal post.

2. Description of the Relevant Art

Conventionally, the battery terminal connector, such as shown in FIGS. 5 and 6 has been known. The conventional battery terminal connector has, as shown in FIG. 5, a post fixing portion 2 formed at one end of a metal body 1 so as to be applied onto and to be fixed on a battery terminal post A which has a circular truncated conical shape, and a stud bolt 3 provided at another end of the metal body 1, on which a connecting terminal of a cable B is fixed. Such a conventional battery terminal connector is produced by punching a metal plate and pressing the punched plate so as to form the terminal connector of finished shape. The post fixing portion 2 has an open or cut portion 2*a* at a part of a ring-like peripheral portion thereof and the open portion 2*a* has a pair of projecting parts 2*b*, 2*b* respectively projected from the ring-like peripheral portion. A pair of bolt holes 2*c*, 2*c* are formed in the projecting parts 2*b*, 2*b* respectively, through which holes 2*c*, 2*c* a bolt 4 is inserted and a nut 5 is applied and engaged onto an end of the bolt 4. Firmly engaging the bolt 4 and nut 5 causes the post fixing portion 2 to be fixed to the battery terminal post A.

However, in the conventional battery terminal connector having the post fixing portion such as described above, it is necessary to give strong rigidity to the projecting parts 2*b*, 2*b* and consequently they are likely to be made large in size. As a result, there is a drawback that it is difficult to mount the post fixing portion 2 to the battery terminal post A if an obstruction such as a member C in FIG. 6 is provided near the terminal post A.

In order to obviate the drawback, the present inventor of this invention invented a battery terminal connector for a battery cable terminal of small, yet adequate strength, which was filed with the Japanese Patent Office under Utility Model Application No. 115071/1985, published Feb. 16, 1987. The terminal connector according to the previous application is manufactured by punching a shape of the sheet material 10 out of a metal plate and folding the shaped sheet material 10 to form a metal body 11 which forms a main portion of the battery terminal connector as shown in FIGS. 7 and 8. The metal body 11 has at one end thereof a battery terminal post fixing portion 11*a* which has a fixing hole 12 therein, and at another end thereof a stud bolt fixing portion 11*b*. It is apparent that a stud bolt 13 is fixed to the stud bolt fixing portion 11*b* by means of a hole 10*f* provided at the central portion of the stud bolt fixing portion 11*b* and that the battery cable terminal B is electrically connected to the stud bolt 13.

A cylindrical bolt fastening portion 14 is formed at a side of the battery terminal post fixing portion 11*a* of the metal body 11 for fixing the fixing hole 12 to the battery terminal post A, with a securing bolt 15 being inserted into a cylindrical inner space of the cylindrical bolt fastening portion 14.

As apparent from the drawing, a slit 17 passing transversely through the bolt fastening portion 14 extends to the peripheral edges of the battery terminal post fixing hole 12 and cuts the edges of the battery terminal post fixing hole.

When a bolt 15 passing through said cylindrical inner space and a nut 16*a* are engaged to one end of the bolt 5 through washer 16*b* and the bolt 15 and nut 16*a* are screwed together, the gap of the slit 17 is made narrow to secure or hold the battery terminal post A by a compression of the diameter of the fixing hole 12.

On assembling and producing the battery cable terminal connector of Japanese Utility Model No. 115071/1985, the sheet material 10 of the metal body 11 is folded to obtain the shape of the metal body 11 as shown in FIG. 7, overlapping an upper plate portion 10*a* on a lower plate portion 10*b* or placing the latter under the former. Then, left and right wing portions 10*e*, 10*e* formed at both the sides of a bolt hole 10*f* formed in the upper plate portion 10*a* are respectively bent downwardly as seen in FIG. 10, and thereafter left and right wing portions 10*g*, 10*g* in the lower plate portion 10*b* are twisted at respective neck portions 10*h*, 10*h* to change the wing portions 10*g*, 10*g* from horizontal to vertical direction, respectively. Consequently, a left set of the wing portions 10*e* and 10*g* are situated side by side and a right set of the wing portions 10*e* and 10*g* are also positioned side by side as shown in FIG. 10. A square head stud bolt 13 is inserted through the hole 10*f* from down side of the metal body 11 and both the piled or laminated wing portions 10*e*, 10*g* and 10*e*, 10*g* are bent at their lower end portions at the horizontal directions so as to embrace or hold the square head of the stud bolt 13 (see FIG. 9A, B and C) firmly.

However, there are also drawbacks present in the conventional battery terminal connector which is produced in the manner mentioned above. Each set of the wing portions 10*e*, 10*g* and 10*e*, 10*g* must be bent together or simultaneously after they are piled, so that both the sets are difficult to precisely bend at a right angle since each of the wing portions 10*e*, 10*g* and 10*e*, 10*g* are only piled on each other.

Because each of wing portions 10*g*, 10*g* is twisted at the neck portion 10*h*, 10*h*, much stress and strain are concentrated at the neck portions 10*h*, 10*h* after twisting. In operation, when the battery cable terminal B is, for example, pulled violently and consequently a large load is applied to the stud bolt 13, or repeating load or vibration is applied to the battery cable terminal B and the stud bolt 13, stress and strain are concentrated at the neck portions 10*h*, 10*h*, resulting in breakage or cut of the portions 10*h*, 10*h* disadvantageously.

SUMMARY OF THE INVENTION

It is a main object of the present invention to provide a battery terminal connector for accurately and firmly fixing a terminal of a battery cable to a post-like battery terminal.

It is another object of the present invention to provide a battery terminal connector of robust construction to precisely place a stud bolt in the structure of the connector having none of the drawbacks mentioned above.

It is still another object of the present invention to provide a battery terminal connector made of a single metal plate, which plate is punched to obtain a metal sheet material of the particular two-dimentional shape described above and then pressed to form a metal body of the particular three-dimensional shape described above.

It is still another object of the present invention to provide a battery terminal connector for reliably holding the stud bolt in the construction of the connector by embracing the square head of the stud bolt.

It is a further object of the present invention to provide a battery terminal connector for securely placing and erecting the stud bolt on the connector structure by supporting the bottom face and the sides of the head of the inverted stud bolt by extending parts of the metal body.

The foregoing objects are accomplished in one embodiment by providing a battery terminal connector for connecting a terminal of a battery cable to the negative or positive post-like terminal of the battery or cell, which battery terminal connector has a metal body which is made of a piece of metal sheet material having an upper plate portion and a lower plate portion. The metal body has a section on which a post fixing portion to be applied to the post-like terminal is formed and another section on which a stud bolt fixing portion is formed. In the stud bolt fixing portion an inverted stud bolt of a square head is placed. The seat face of the bolt contacts the under face of the upper plate portion of the metal body of the connector and the bottom face of its head contacts the top face of the lower plate portion thereof when the threaded portion of the stud bolt is passed through a bolt hole formed in the stud bolt fixing portion. Wing portions of the upper plate portion and the lower plate portion are bent once or twice to hold and embrace the square head of the bolt.

These and other objects and advantages of the present invention will be more clearly understood by referring to the following description and accompanying drawings, in which:

DESCRIPTION OF THE PREFERRED EMBODIMENTS

Figure 1:
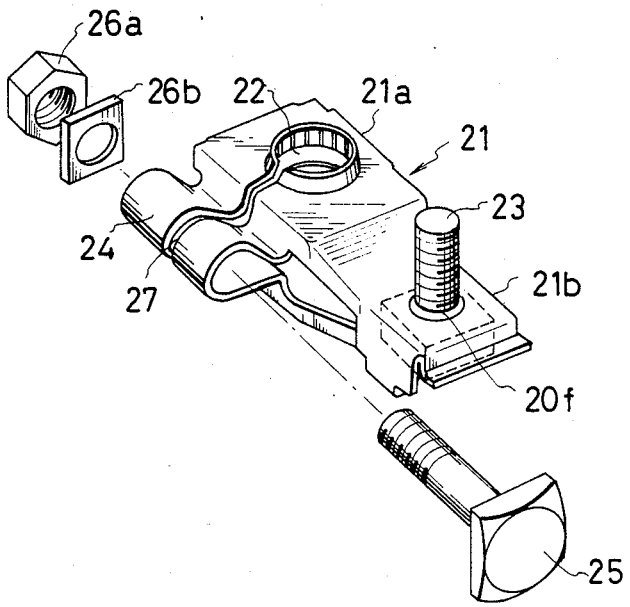
FIG. 1 is a perspective view showing an embodiment of the battery terminal connector of the present invention.
Figure 2:
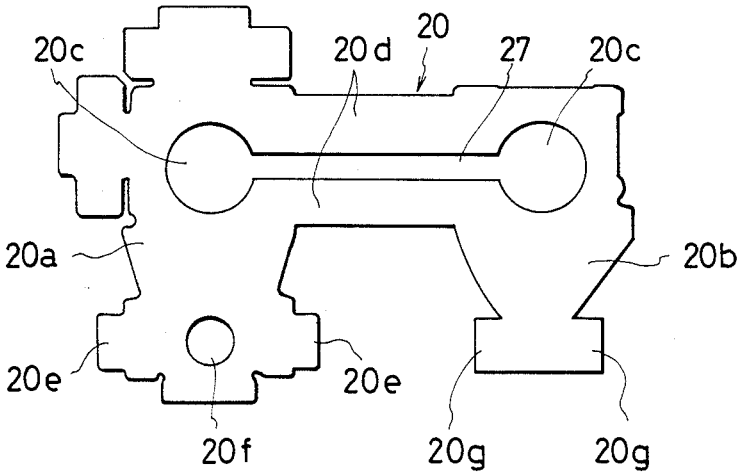
FIG. 2 is a plan view showing a metal sheet material 20 to be assembled to form the metal body shown in FIG. 1.
Figure 7:
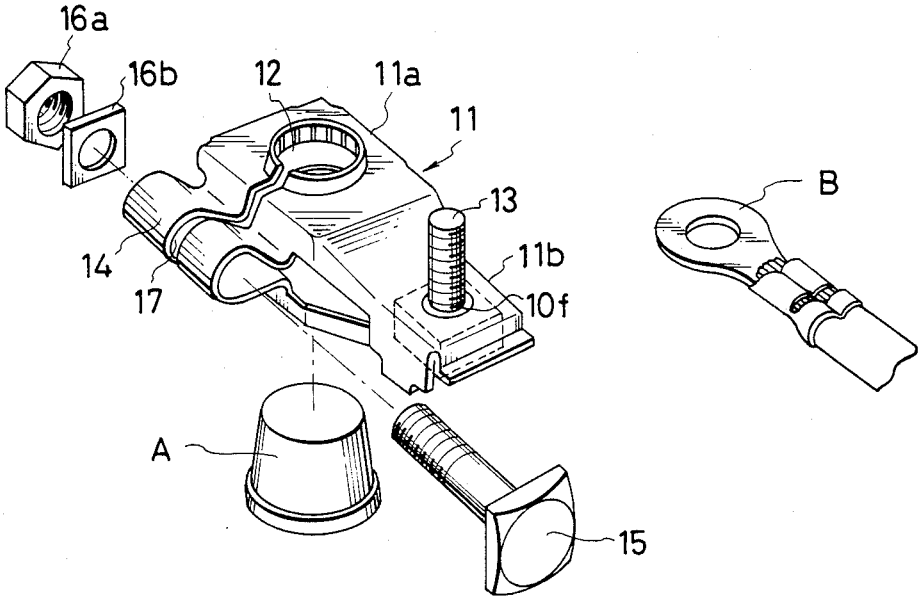
FIG. 7 is a perspective view of the battery terminal post connector according to the previous invention of the present inventor.
Figure 8:
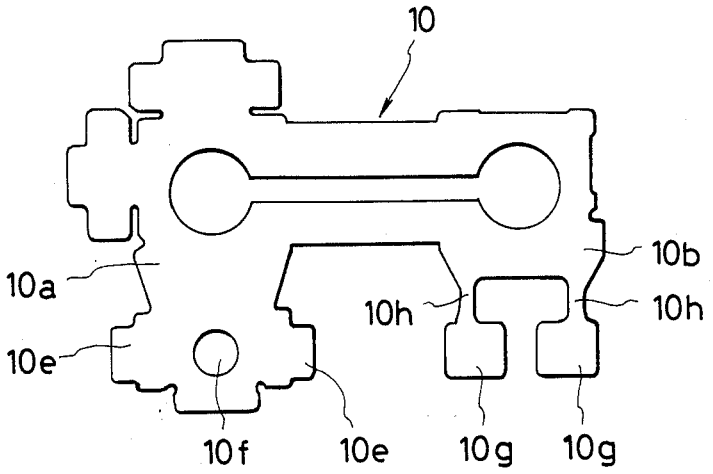
FIG. 8 is a perspective view of the metal sheet material from which the connector of FIG. 7 is formed.
Figure 9A:
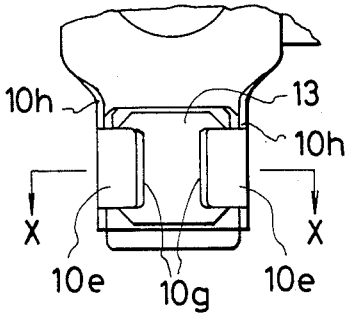
FIG. 9(A), (B) and (C) are the same views as those of FIG. 3, but showing the manner of holding the stud bolt by the conventional connector.
Figure 10:
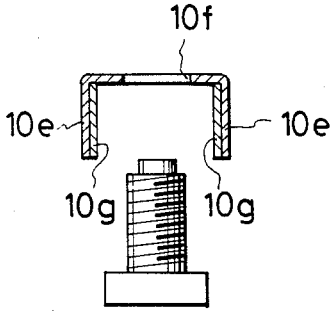
FIG. 10 is a sectional view showing how to provide the stud bolt with the stud bolt fixing portion.
Figure 9B:
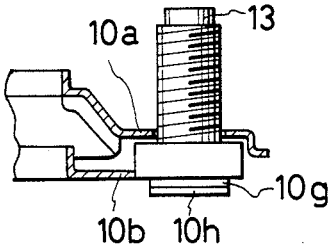
Figure 9C:
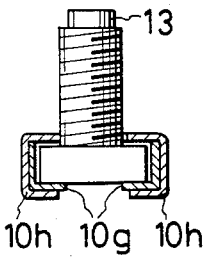

FIGS. 1 to 3 show the preferred embodiment of the present invention. A metal sheet material 20 having a particular geometrical shape as shown in FIG. 2 is punched in a conventional manner. The metal body 21 of the connector is formed by pressing a metal sheet material 20 using a particular die (not shown). As is apparent, the post fixing portion 21*a* of the metal body 21 has the same construction as that of FIG. 7 showing the previous invention of Japanese Utility Model No. 115071/1985. The whole structure of the metal body 21 differs from that of the connector shown in FIG. 7 in only a construction of the stud bolt fixing portion 21*b* in which a stud bolt 23 is placed. Consequently, as to the geometrical shape of the metal sheet material 20, a shape of an upper plate portion 20*a* of the metal sheet material 20 according to the present invention is the same as that of the upper plate portion 10*a* of the metal sheet material 10 according to the previous invention, as shown in FIG. 8.

In order to assemble or produce the connector shown in FIG. 1 from the metal sheet material 20 shown in FIG. 2, the edge portions or side portions of a main part of the metal sheet material 20, through which a slit 27 extends between an upper hole 20*c* and a lower hole 20*c*, are bent downward or upward by a press. The central portion 20*d* of the main part is curled to form a cylindrical bolt fastening portion 24 through which a fastening bolt 25 passes, and to make the upper plate portion 20*a* placed correspondingly on the lower plate portion 20*b* of the metal sheet material 20.

In this construction shown in FIG. 1, both the upper hole 20*c* and the lower hole 20*c*, respectively formed in the metal sheet material 20 are faced to each other, forming a fixing hole 22 of the battery post fixing portion 20*a* and both the upper plate portion 20*a* having the stud bolt hole 20*f* and the lower plate portion 20*b* are faced to each other, forming a stud bolt fixing portion 21*b* in which portion the stud bolt 23 is supported.

Figure 3A:
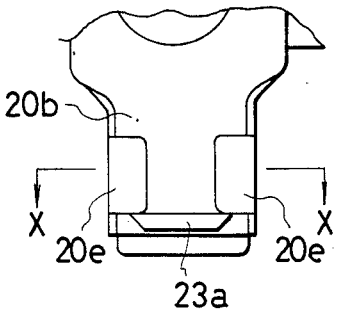
FIG. 3(A) is a bottom view of the stud bolt fixing portion of the connector.
Figure 3B:
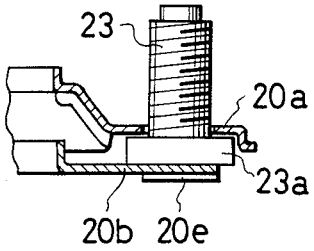
FIG. 3(B) is a vertical sectional view of the portion.
Figure 3C:
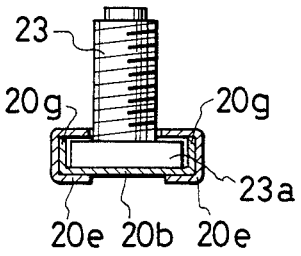
FIG. 3(C) is a sectional view taken along the line x—x of FIG. 3(A)

Before the metal sheet material 20 is curled at the central portion 20*d* to form the cylindrical portion 24, the square-headed stud bolt 23 is inserted through the bolt hole 20*f* and a pair of wing portions 20*g*, 20*g* located at the opposite sides of the end portion of the lower plate portion 20*b* are bent upwardly so as to receive the opposite sides of the square head 23*a* of the stud bolt 23 therebetween as shown in FIG. 3(C). In this case, each wing portion in the lower plate has an area substantially the same as that of the side surface of the square head of the stud bolt. Wings 20*e*, 20*e* formed at both sides of the stud bolt hole 20*f* are also bent upwardly in FIG. 2, which are directed downwardly when the connector is assembled as shown in FIG. 1, so as to sandwich the wing portions 20*g*, 20*g* therebetween from the outside. As a result, the seat face of the square head 23*a* of the stud bolt 23 contacts the lower face of the upper plate portion 20*a* around the bolt hole 20*f* and the bottom face of the square head 23*a* contacts the upper face of the lower plate portion 20*b*. Then, the wing portions 20*e* , 20*e* are respectively bent at a right angle so as to place the wing portions 20*g*, 20*g* which sandwiches the square head 23*a* therebetween. Thereafter, the wing portions 20*e*, 20*e* are further bent inwardly at a right angle to the horizontal direction so as to embrace the wing portions 20*g*, 20*g*, thereby holding the square head 23*a* upwardly. Thus, an assembly or erection of the stud bolt 23 is completed.

On the assembled battery terminal connector as shown in FIG. 1, the construction of stud bolt fixing portion 21*b* is made clear by FIG. 3(A) depicting the bottom view of the portion 21*b*, FIG. 3(B) showing the vertical sectional view thereof, and FIG. 3(C) depicting the transverse sectional view taken along the line x—x in FIG. 3(A).

Figure 5:
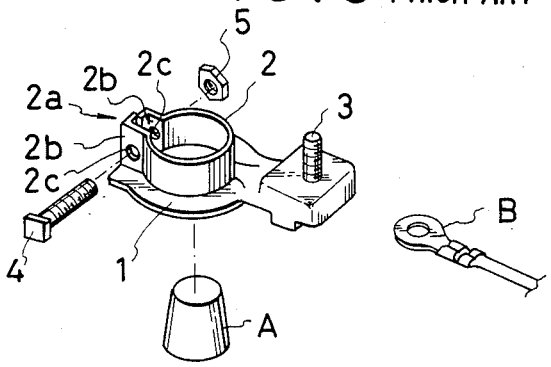
FIG. 5 PRIOR ART
FIG. 5 is a perspective view showing a prior art battery terminal post connector.
Figure 6:
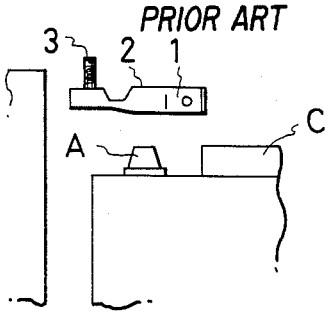
FIG. 6 PRIOR ART
FIG. 6 is a side elevational view showing how to apply the conventional connector onto the terminal post.

In order to fix the battery terminal connector of the present invention onto the battery terminal post A (see FIGS. 5 and 7), the fixing hole 22 of the post fastening portion 21*a* is placed onto the terminal post A, projecting its top end portion out of the fixing hole 22, and the fixing bolt 25 is inserted through the cylindrical bolt fastening portion 24 made of the central portion 20*d*. A nut 26*a* is engaged onto the threaded end portion of the fixing bolt 25 through washer 26*b* and the nut 26*a* is rotated to pull the bolt 25, making the gap 27 narrow to fix the terminal post A to the connector or the metal body 21. The procedure mentioned above is the same as that of the previous invention since the construction of the main part of the metal sheet material 20 including two holes 20*c*, 20*c* is the same as that of the metal sheet material 10 shown in FIG. 8.

According to the present invention, the lower plate portion 20*b* provided with a pair of wing portions 20*g*, 20*g* is made of a single metal piece, compared to the one of the previous invention provided with a pair of separated flap-like portions 10*g*, 10*g*, so that as is apparent the strength of the lower plate portion 20*b* having the wing portions 20*g*, 20*g* is stronger than the prior art having separated flap-like portions 10*g*, 10*g* resisting efficiently a large force which may be applied to the stud bolt 23 through the cable terminal B and the cable.

Figure 4:
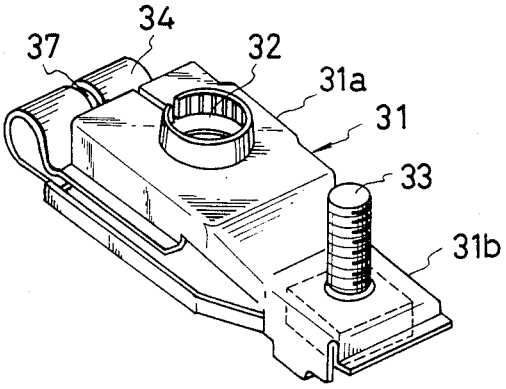
FIG. 4 is a perspective view depicting another embodiment of the battery terminal connector.

FIG. 4 shows another preferred embodiment of the present invention which has one significant difference from the first embodiment described above. The difference concerns the construction of the main body, in particular the position of the cylindrical bolt fastening portion 34 through which a fastening bolt 35 passes to narrow the slit 37 and to firmly grip the terminal post A with a fixing hole 32 provided in a battery terminal post fixing portion 31*a*. As is apparent the cylindrical bolt fastening portion 34 is turned at a right angle relative to that of the above embodiment so as to place it at the position opposite to a stud bolt fixing portion 31*b*. The construction of a stud bolt fixing portion 31*b* is not altered from the previous embodiment and the manner of the holding and embracing mechanism of the stud bolt is also not changed.

Because the battery terminal conductor according to the present invention has a pair of wing portions 20*g*, 20*g* integrally connected to the lower plate portion 20*b* of the metal sheet material 20 and these wing portions 20*g*, 20*g* embrace the square head 23*a* of the stud bolt 23 and the central portion of the lower plate portion 20*b* holds the head upwardly, the bolt head 23*a* can be temporarily positioned place by means of the wing portions 20*g*, 20*g* of the lower plate portion 20*b* and then firmly fixed at the predetermined place by bending the wing portions 20*e*, 20*e* at a right angle. As a result, the stud bolt 23 is firmly secured, and even if great shock is applied to the bolt, no deformation and no breakage of the bolt will occur.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A battery terminal connector formed of a metal sheet material, which is punched and pressed from a single metal piece comprising:
   - a metal body, which is formed by folding the metal sheet material, having a post fixing portion, a stud bold fixing portion and a cylindrical portion;
   - a fixing hole having a variable diameter for receiving a terminal post therein provided in the post fixing portion;
   - a stud bolt, which has a square head, provided in the stud bolt fixing portion;
   - a fastening bolt passing through the cylindrical portion for compressing of the diameter of the fixing hole;
   - said stud bolt fixing portion comprising an upper plate portion having a stud bolt hole formed therein and a lower plate portion of the metal sheet material further comprising;
   - a pair of wing portions adapted to be bent at a right angle to the plane of the sheet metal material provided in the lower plate portion to sandwich the square head of the stud bolt from the opposite sides thereof and support the square head upwardly; and
   - a pair of wing portions provided in the upper plate portion to embrace said wing portions provided in the lower plate portion which sandwiches the square head of the stud bolt, and the threaded portion of the stud bolt being projected through said stud bolt hole in the upper plate portion;
   - wherein said lower plate portion provided with a pair of wing portions is made of a single metal piece, whereby the strength of said wing portions of said lower plate portion is increased.

2. A battery terminal connector as set forth in claim 1, wherein said cylindrical portion has a slit in the circumferential direction thereof for compressing the diameter of the fixing hole by threading of the fastening bolt in said cylindrical portion and said cylindrical portion is provided on the lateral position of the metal body opposite to the position at which said stud bolt is located.

3. A battery terminal connector as set forth in claim 1, wherein said lower plate portion has an end portion and wherein said wing portions in the lower plate portion are located at opposite sides of the end portion of the lower plate portion.

4. A battery terminal connector as set forth in claim 3, wherein each wing portion in the lower plate portion has an area substantially the same as that of the side surface of the square head of the stud bolt.

* * * * *

UNITED STATES PATENT AND TRADEMARK OFFICE

CERTIFICATE OF CORRECTION

PATENT NO. : 4,747,793

DATED : May 31, 1988

INVENTOR(S) : Kiyohito FUKUDA; Takao MURAKAMI

It is certified that error appears in the above-identified patent and that said Letters Patent is hereby corrected as shown below:

IN THE SPECIFICATION:

Column 2, line 35, delete "conventional";

line 67, "two-dimentional" should be

--two-dimensional--;

IN THE CLAIMS:

Claim 1, line 6, "bold" should be --bolt--.

Signed and Sealed this

Twenty-seventh Day of December, 1988

*Attest:*

DONALD J. QUIGG

*Attesting Officer*

*Commissioner of Patents and Trademarks*